United States Patent [19]

Keithley, Jr.

[11] Patent Number: 4,901,420

[45] Date of Patent: Feb. 20, 1990

[54] METHOD OF MAKING AND USING A SHAPE ADAPTABLE PROTECTIVE CUSHIONING DEVICE

[75] Inventor: Howard W. Keithley, Jr., Adelphi, Md.

[73] Assignees: Marie E. Keithley; Steven W. Keithley; Gwenn M. Kelly, Adelphi, Md.

[21] Appl. No.: 97,752

[22] Filed: Sep. 17, 1987

Related U.S. Application Data

[62] Division of Ser. No. 717,793, Mar. 29, 1985, Pat. No. 4,694,774.

[51] Int. Cl.[4] ..... B23P 17/00; B21B 1/46; B22D 11/126

[52] U.S. Cl. ..... 29/417; 29/458; 29/527.2; 29/513; 52/716; 49/462; 248/345.1

[58] Field of Search ..... 29/411, 417, 458, 469.5, 29/527.2, 513, 412; 248/345.1; 49/462; 52/716; 135/120; 264/251; 24/455, 470, 564

[56] References Cited

U.S. PATENT DOCUMENTS

| | | | |
|---|---|---|---|
| 1,197,769 | 9/1916 | Shane | 49/462 |
| 1,804,841 | 5/1931 | Pedroli | 248/345.1 |
| 2,277,742 | 3/1942 | Crawford | 135/120 |
| 2,718,485 | 9/1955 | Samuely | 29/458 UX |
| 2,954,310 | 9/1960 | Truesdell et al. | 52/716 X |
| 3,058,208 | 10/1962 | Haushalter | 29/458 X |
| 3,089,276 | 5/1963 | Brooks | 248/345.1 |
| 3,192,542 | 7/1965 | Mills II . | |
| 3,197,821 | 8/1965 | Bright | 52/716 X |
| 3,451,169 | 6/1969 | Arnold et al. | 52/716 X |
| 3,455,018 | 7/1969 | Collins | 29/458 X |
| 3,634,925 | 1/1972 | Van Loo | 29/458 |
| 3,916,055 | 10/1975 | Wagner | 52/716 X |
| 3,973,720 | 8/1976 | Schmid . | |
| 4,143,653 | 3/1979 | Wichman | 128/87 A |
| 4,334,700 | 6/1982 | Adell | 49/462 X |

*Primary Examiner*—Charlie T. Moon
*Attorney, Agent, or Firm*—John W. Huckert

[57] ABSTRACT

The method of making and using a flexible protective pad device includes forming a spine or base member with a plurality of lateral arms or projections extending from same. The lateral arms or projections extend from opposite sides of the spine or base member. The tips of the lateral arms or projections are coated or covered with resilient material such as liquid rubber, and resilient cushions are affixed or applied to the spine or base member to form the overall device. In using the device it is positioned upon a component on an article such as a boat to be protected, and the lateral arms or projections are bent about the component to substantially conform to the component. The spine or base member likewise may be shaped to conform to the component. Then an overall cover is applied over the protective device or devices as installed.

7 Claims, 3 Drawing Sheets

METHOD OF MAKING AND USING A SHAPE ADAPTABLE PROTECTIVE CUSHIONING DEVICE

This is a division of application Ser. No. 717,793, filed Mar. 29,1985now U.S. Pat. No. 4,694,774.

BACKGROUND OF THE INVENTION

1. Field of the Invention

This invention relates generally to devices for protecting covers or tarpaulins utilized for covering large articles such as boats, automobiles, trailers and the like, particularly when such covered articles are stored outside in exposure to sun, wind, snow or rain.

2. Description of the Prior Art

Devices for protective padding for covers or tarpaulins, particularly covers of fabric, are generally nonexistent. The closest known prior art patent which may be pertinent to the present invention is U. S. Pat. No. 3,634,925, granted on Jan. 18, 1972 to William R. Van Loo, which shows a method of assemblying a padded arm rest. In this patent, a channel member is placed in a mold and covered with plastic foam such as polyurethane, vinyl or other suitable material. Metal flanges of the channel are bent to secure the padded arm rest permanently to the chair structure. However, this known device does not offer the new and novel features of the present invention, in that only a very specific and limited use is provided thereby. The present invention is ideally suited to be temporarily, but securely, fastened to many differently shaped structures.

Additional patents which have been considered are U.S. Pat. Nos. 2,277,742 to Crawford, 3,192,542 to Mills, II, 3,973,720 to Schmid, and 4,143,653 to Wichman. However, none of these patented devices solve the problems described above and solved by the present invention.

For example, the device of Crawford for protecting canvas tents shows an elongated length of fabric which is adapted to overlie the top edge of a rafter which has attaching clips secured thereto and depending from the bottom face thereof, the clips having terminal portions configured to engage the bottom side edges of the rafter.

The Mills, II device is for a fabric cover for boats, which essentially comprises a flexible cover for the boat together with bendingly resilient fastener members secured to the body portion of the cover member at intervals along its edge and having portions thereof which extend across the outer surface of the boat's gunwale guard and resiliently contact the underside of the guard.

The Schmid patent is a protective cushioning pad having foldable sections for protecting the edges and corners of articles being packaged. The specific structure and arrangement of this device is substantially different from that of the present invention.

The Wichman patent shows a device for splintering broken extremities and comprises a flexible strip having individual perpendicular projections along one edge together with a cushioning element. Again, this structure is entirely different from that of the present invention.

SUMMARY OF THE INVENTION

An object of the present invention is to provide a simply constructed, shape adaptable, flexible protective pad for covers overlying large articles such as boats, automobiles, trailers, trucks, or the like.

Another object of the present invention is to provide an easily installed, semi-permmanent, flexible protective pad which can be fabricated in quantity and in a cost-effective manner.

A further object of this invention is to provide a flexible protective pad which is simple to install, equally simple to remove, but can be secured in place to resist migration away from stress points.

Another further object is to provide a flexible protective pad which can be angularly adjusted as well as bent to conform to any compound corner configuration.

Another still further object of the present invention is a method of making a protective pad device having a base member with pairs of projecting arms therefrom, the base member having a semi-rigid plastic cushioning element affixed thereto and a least the extremities of the extending arms being coated with frictional cushion material.

A still further object of the present invention is to provide a protective pad having pairs of opposed arms extending from a central base, the opposed pairs of arms being directly opposed with respective pairs of arms parallel to the other pairs, or with the respective pairs being substantially at right angles to other pairs, or with the opposed arms of each pair being offset in relation to each other. These variations permit very specific components to be properly and adequately covered for protection of an external cover to be applied later.

Finally, a still further object of the present invention is a method of using to provide a flexible protective pad which can be strategically located on or adjacent to irregularly shaped structures which generally put stress upon tightly stretched covers and thus can cause damage such as ripping and tearing of such covers.

Another important feature of the present invention is a method of making a flexible protective pad which will present soft, rounded contours to fabric covers or tarpaulins which may shrink from the effects of rain, wind and drying sun and therefore rip or tear at certain stress points.

The present invention offers many very important and desirable advantages and benefits over the known prior art. A plurality of protective pad devices of the present invention can be manufactured in a string of multiple units, and the after manufacture, an appropriate number of units, and/or groups of units, can be selected and detached from the main roll or supply thereof. The basic structure of each protective pad is a central base together with projecting arms extending therefrom. The projecting arms can be directly opposed, or can be opposed but in staggered relationship, or the pairs of opposed arms can be parallel to the other pairs, or the various pairs can be at angles relative to each other up to right angle or 90° configurations. The base can be bendable by use of suitable material for the base, or the base may be provided with a hinge portion for maximum bendability and shape forming ability thereof.

Preferably, each base member is provided with a semi-rigid mass of cushion material such as urethane foam, sheet foam, resin material having open or closed cells, hard rubber, synthetic rubber, or any other type material which is semi-resilient and yet rather firm and hard. At least the end extremities of the projecting arms should be coated or covered with semi-resilient and fairly high friction retention material, the purpose of this being to provide increased friction at the tips of the bendable projecting arms. Also, in many cases it is highly desirable to provide the entire undersurface, or surface opposite to the mass of semi-rigid cushioning material, with this semi-resilient friction material. For example, when applying one of the elongated protective pads to a boat cleat, the embodiment of this invention having offset opposed projecting arms and completely covered with semi-resilient cushion/ friction material on the undersurface opposite the mass cushion block allows a very well fitted attachment of the overall device to the boat cleat.

It should be emphasized that the purpose of the protective pads of the present invention is for providing adaptability of the devices to many areas of a boat, and/or other units such as automobiles or trucks, which needs to be covered and protected by a tarpaulin or the like. Tarpaulins and specifically configured covers for boats, trailers, etc. are very expensive. Even the most common sizes and relatively small tarpaulins today are expensive. Thus, it is highly desirable for anyone using such covers to protect same against ripping or tearing in use. By using the protective pads of the present invention in the manner set forth, this can be easily achieved.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
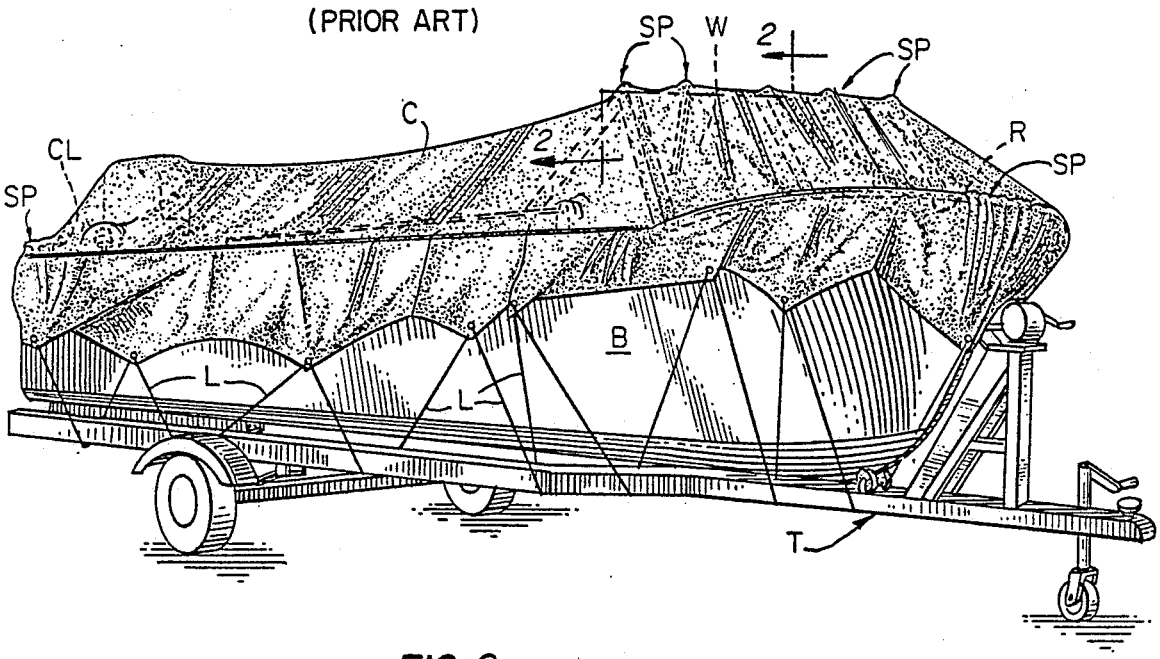
FIG. 1. (PRIOR ART)
FIG. 1 is a perspective view of a small craft protected by a storage cover.
Figure 2:
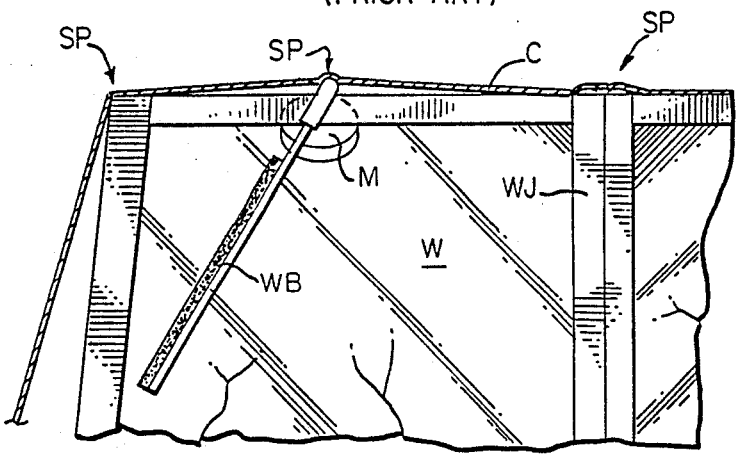
FIG. 2. (PRIOR ART)
FIG. 2 is a fragmentary sectional view taken along line 2—2 of FIG. 1.

In the perspective view of FIG. 1, there is shown a small craft B cradled upon a trailer T snugly shrouded by a cover C which is securely fastened in place by ropes or lines L, in accordance with present practice. Multiple stress points SP are indicated, particularly with respect to the windshield W, stern cleat CL and bow rail R, all of which are potential damage areas to cover C, as best shown in FIG. 2. FIG. 2 shows the windshield joint WJ having at the top edge thereof a stress point SP and a windshield blade WB connected to wiper motor M having another stress point SP at the top connection thereof, and, of course, at the edge of the windshield, another very pronounced stress point is present.

The flexible protective pad 10 of FIG. 3 which is adapted to conform to boat structure, as will be later described, is fabricated of a flexible base 12 having lateral, bendable arms 14 with padded tips 16 connected by means of a rivet 18 or other suitable means to a base extension 22, provided with lateral bendable arms 24 also having soft padded tips 16.

Figure 5:
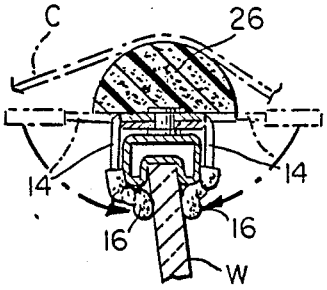
FIG. 5 is a transverse cross-sectional view, as taken along line 5—5 of FIG. 4, and illustrates the flexible protective pad securely crimped in place along a top portion of a boat's windshield.

Adhesively or otherwise secured to base 12 is a resilient cushion 26 formed of polyurethane foam, rubber or the like. As shown in FIG. 5, the flexible arms 14 and 24 have been securely crimped in place along the top edge of a windshield W, for example, to offer a softly contoured shape to the overlying cover C.

Figure 7:
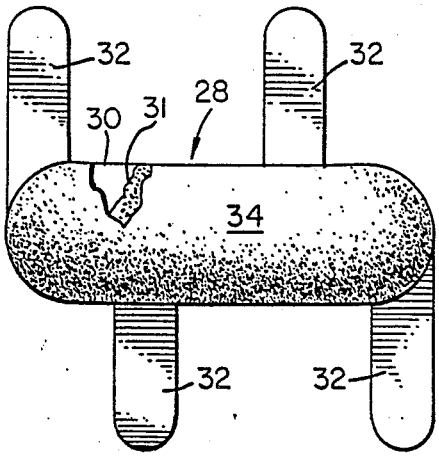
FIG. 7 is a top plan view of a second form of the present invention.

FIG. 7 is illustrative of a one-piece linear flexible pad 28 of the present invention wherein flexible base 30 having lateral offset arms 32 has a resilient cushion 34 affixed thereto by a layer of adhesive 31.

Figure 3:
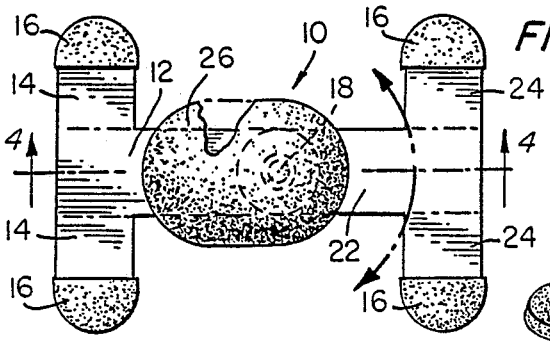
FIG. 3 is a plan view of a first form of the invention comprising an articulated flexible protective pad.
Figure 6:
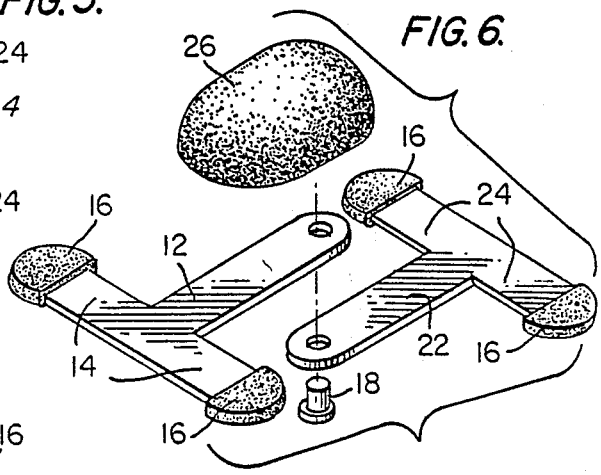
FIG. 6 is an exploded perspective view of the flexible protective pad of FIG. 3.
Figure 4:
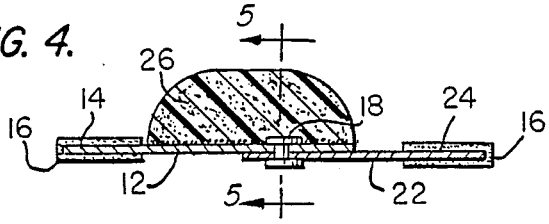
FIG. 4 is a vertical longitudinal sectional view taken along line 4—4 of FIG. 3.
Figure 8:
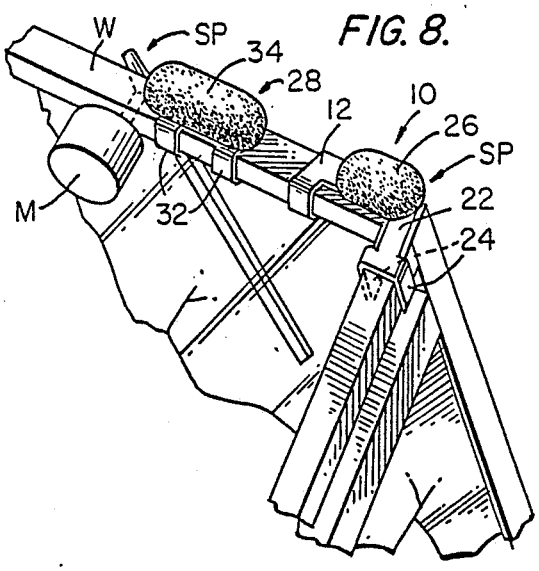
FIG. 8 is a fragmentary perspective view of a boat windshield with both types of flexible protective pads mounted thereon.

FIG. 8 shows the pivoted pad 10 of FIG. 3 crimped in place along the top corner of a boat windshield W with the base extension 22 pivoted into a compound 90° angle and with the second pad 28 securely crimped alongside thereof to offer padding to both the stress points SP as shown.

Figure 10:
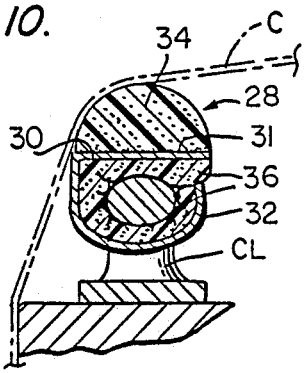
FIG. 10 is a transverse cross-sectional view taken along line 10–10 of FIG. 9.
Figure 9:
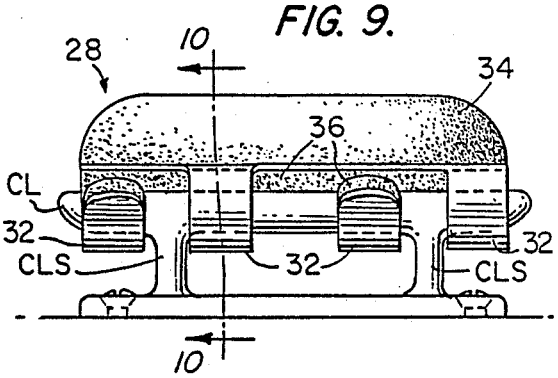
FIG. 9 is a side elevation of the flexible protective pad of FIG. 7 crimped upon a cleat.

In FIG. 9, the linear flexible protective pad 28 of FIG. 7 is shown with offset arms 32 having urethane foam 36 applied along the bottom surface thereof for securely embracing the surfaces of a cleat CL to present resilient pad 34 to cover C in a softly contoured angle, as shown in FIG. 10.

As is seen in FIG. 10, the semi-resilient and friction retention material 36 completely surrounds the cleat and thus provides an extremely secure attachment of the protective pad device 28 to the cleat. As seen in FIG. 9, because of the arms 32 which are opposed to each other being offset, each respective pair can interengage around a cleat closely adjacent to the cleat supports CLS. Thus, the protective pad cannot slide either forwardly or rearwardly off of the cleat, which is the problem with so many prior protective type devices.

Figure 11:
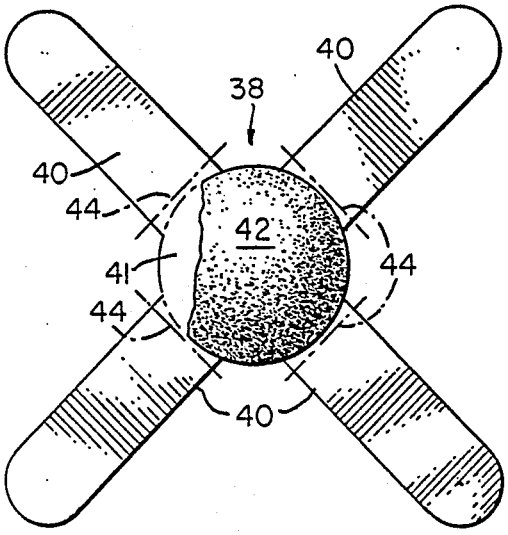
FIG. 11 is a top plan view of another form of the present invention.
Figure 12:
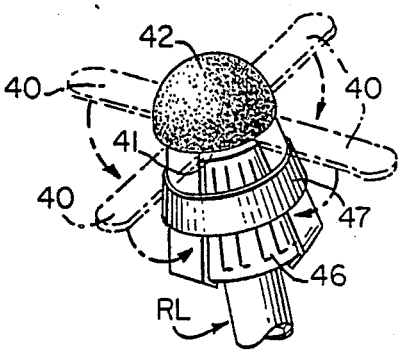
FIG. 12 is a perspective view of the structure of FIG. 11 crimped onto a boat's running light.

FIG. 11 illustrates a flexible protective pad 38 on a disc 41, having bendable "X" shaped arms 40. The arms 40 are bent along lines 44, as shown in FIG. 12, for example, to surround the lens 46 of a running light RL, and are secured to each other by tape 47. It is obvious that the arms 40 can be bent to conform to various diameters as needed, and need not be taped together at all.

In this embodiment of FIGS. 11 and 12, the friction retention, semi-resilient material, such as 36 of the previous embodiment, has been omitted. However, it may be provided if desired, and has been omitted from the showings primarily for the purpose of showing that in some type of applications the protective pad will function adequately without the semi-resilient friction retention material. However, for all of the preferred configurations, the friction retention, semi-resilient material is preferred.

Figure 13:
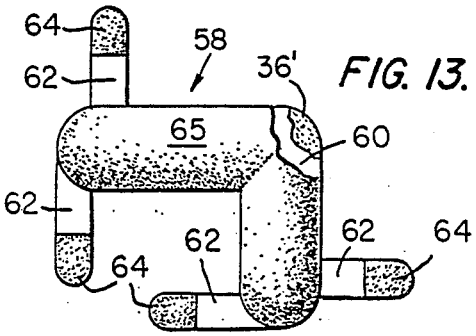
FIG. 13 is a top plan view of a fourth form of the present invention particularly for padding outside and inside corner configurations.

FIG. 13 discloses an "L" shaped protective pad 58 which is particularly adapted to outside or inside corners as required. Base 60 is provided with arms 62, which are offset with respect to one another. Arms 62 are also padded at their extremities with neoprene rubber 64, or other similar resilient material having a high frictional coefficient. A resilient L-shaped cushion 65 is formed on the base member 60. This modification is particularly effective in padding sharp corners of windshields or other 90° configurations. As seen in the broken away section, a semi-resilient friction retention layer 36' has been applied to the undersurface of this embodiment. Again, in some versions this could be eliminated; however, in the preferred embodiments, it is used. While 90° is a very usable configuration, obviously 60° or 30° forms could be provided if desired.

Figure 14:
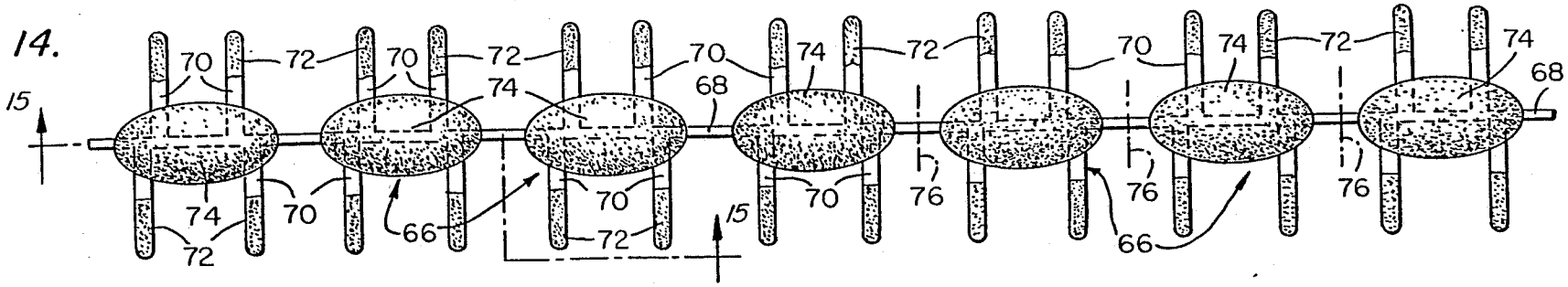
FIG. 14 is a top plan view depicting a method of forming multiple units of the present invention.
Figure 16:
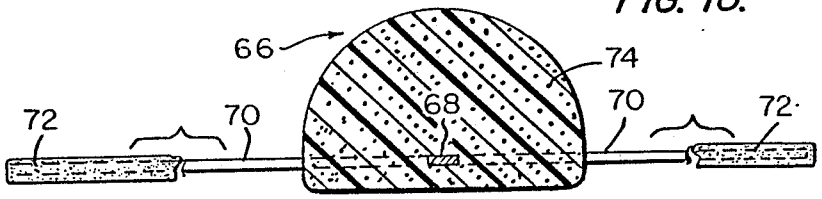
FIG. 16 is an enlarged transverse cross-sectional view taken along line 16-16 of FIG. 15.
Figure 15:
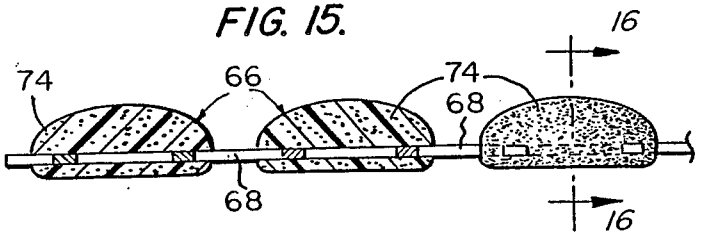
FIG. 15 is a vertical sectional view taken along line 15—15 of FIG. 14.

FIG. 14 is illustrative of a method of multiple fabrication of the flexible protective pads 66 of the present invention. In this figure, a fifth embodiment of the invention is depicted wherein the base of each pad device is of bendable material and the bendable arms 70 which project from opposing sides of the base are staggered in relationship to each other. Notice the difference between this staggering and the staggering of the FIG. 7 second embodiment. During manufacture of this embodiment, the entire length of the spine can be stamped from a roll of sheet metal with simultaneous forming of the spine together with the projecting arms. After forming of the overall base structure, then the appropriate cushioning materials can be applied. As shown, a continuous spine 68 is formed with integral bendable arms 70 having rubber or neoprene tips 72 and resilient pads 74 at spaced intervals thereon. The completed assembly of flexible protective pads 66 can be left intact, as manufactured, or individual pads 66 can be cut apart along cut lines 76.

Figure 18:
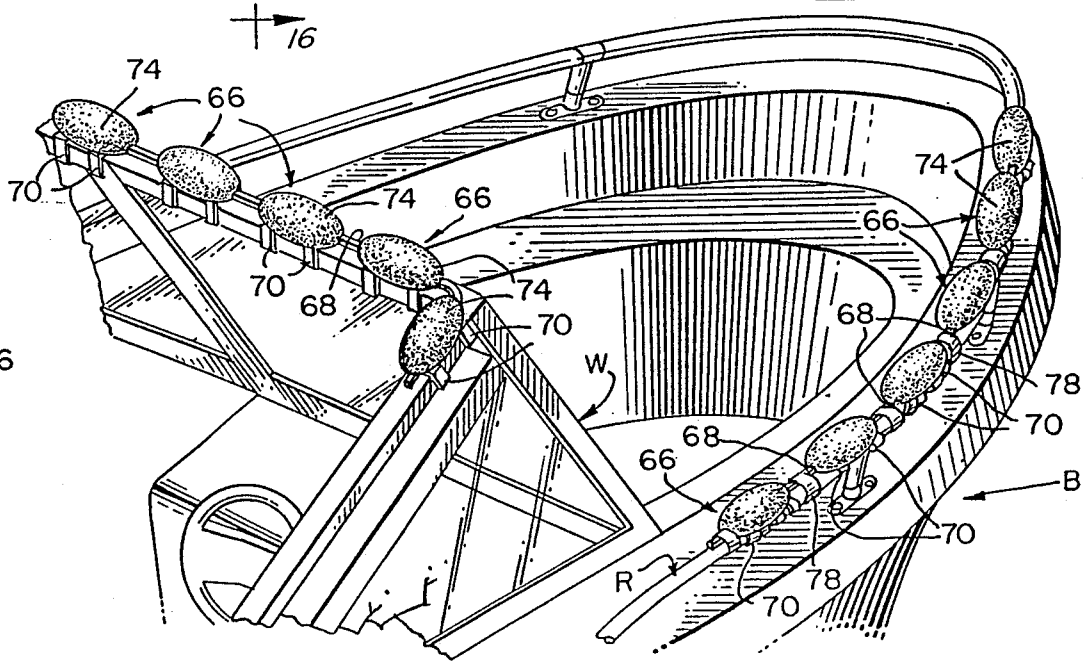
FIG. 18 is a fragmentary perspective view of a boat bow rail and windshield provided with the flexible pads of FIG. 15.
Figure 17:
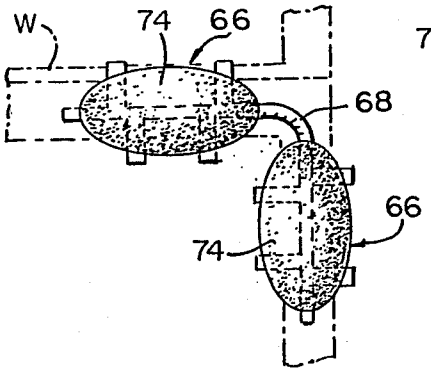
FIG. 17 is a top plan view of the corner portion of a boat windshield padded by two components of the structure of FIG. 14.

As best shown in FIGS. 17 and 18, multiples of two, five and six flexible protective pads are shown mounted along windshield W, and bow rail R. Tape 78 may also be utilized in FIG. 18 to secure spine 68 tightly to bow rail R because of the small size of the latter.

Throughout the several forms of the invention, it should be understood that the bendable arms can be trimmed or shortened, or, if necessary, eliminated by merely utilizing metal cutting shears.

Resin material and/or foam material which may be used for the padding material of this invention is as follows:

Synthetic resin foams of thermoplastic or thermoset, open or closed cells material. These foams can be self-foaming, such as polyurethane or polystyrene resin, or they may be synthetic resins which contain a foaming agent such as carbonates or peroxides.

There also can be used natural resins, such as rubber latex, which can be foamed by foaming agents.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of making a plurality of flexible protective pads comprising the following steps:

forming in one piece a bendable spine having offset lateral arm extensions with said lateral arm extensions being on opposite sides of said spine;

coating the tips of the lateral extension arms with liquid rubber; and applying resilient cushions of semi-rigid foam on said spine portions between respective pairs of lateral extension arms.

2. The method of claim 1, together with the additional step of severing the spine between respective pairs of lateral extension arms to create a plurality of protective pad devices for later use individually.

3. The method of claim 2, together with the additional step of severing the spine between groups of protective devices to form sub-components comprising two, three, four, five or any desired number of interconnected protective pads.

4. A method of making a plurality of flexible protective pads comprising the following steps:

forming a bendable spine having a plurality of offset lateral projections with same being on opposite sides of said spine;

coating the tips of the lateral projections with resilient material; and applying cushions of semi-rigid material on said spine portions between respective lateral projections.

5. The method of claim 4, together with the additional step of severing the spine between lateral projections to create a plurality of protective pad devices for later use individually.

6. The method of claim 4, together with the additional step of severing the spine between groups of protective devices to form sub-components comprising two, three, four, five or any desired number of interconnected protective pads.

7. The method of claim 6, including the further step of applying a plurality of said interconnected protective pads to a component to be protected by bending the spine and lateral projections to shapes which conform to said component.

* * * * *